US007500726B2

(12) United States Patent
Hosono et al.

(10) Patent No.: US 7,500,726 B2
(45) Date of Patent: Mar. 10, 2009

(54) LIQUID EJECTING APPARATUS DRIVING-SIGNALS GENERATION

(75) Inventors: Satoru Hosono, Nagano-Ken (JP); Hirokazu Nunokawa, Nagano-Ken (JP); Yoshiko Hoshiyama, Nagano-Ken (JP); Shuji Yonekubo, Nagano-Ken (JP); Toshihisa Saruta, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 338 days.

(21) Appl. No.: 11/393,711

(22) Filed: Mar. 31, 2006

(65) Prior Publication Data

US 2006/0232616 A1 Oct. 19, 2006

(30) Foreign Application Priority Data

Mar. 31, 2005 (JP) ..... 2005-103561

(51) Int. Cl.
*B41J 29/38* (2006.01)
*B41J 2/205* (2006.01)

(52) U.S. Cl. ..... 347/10; 347/11; 347/14; 347/15

(58) Field of Classification Search ..... 347/10, 347/11, 14, 15, 57, 54, 9, 37
See application file for complete search history.

(56) References Cited

U.S. PATENT DOCUMENTS 6,352,335 B1 * 3/2002 Koyama et al. ..... 347/37
6,431,676 B2 * 8/2002 Asauchi et al. ..... 347/10
6,450,603 B1 * 9/2002 Chang ..... 347/10
6,517,176 B1 * 2/2003 Chaug ..... 347/11
6,572,210 B2 * 6/2003 Chaug ..... 347/11
6,758,544 B2 * 7/2004 Fukano ..... 347/9
6,793,324 B2 * 9/2004 Hosono et al. ..... 347/54
7,059,699 B2 * 6/2006 Asauchi et al. ..... 347/10
7,278,698 B2 * 10/2007 Tamura ..... 347/11
2006/0071980 A1 * 4/2006 Usui ..... 347/57
2006/0238554 A1 * 10/2006 Hosono et al. ..... 347/11

FOREIGN PATENT DOCUMENTS

JP 10-081012 A 3/1998
JP 2003-182075 A 7/2003

* cited by examiner

*Primary Examiner*—Stephen D Meier
*Assistant Examiner*—Rene Garcia, Jr.
(74) *Attorney, Agent, or Firm*—Sughrue Mion, PLLC

(57) ABSTRACT

A liquid ejecting apparatus includes: a head having a nozzle; a pressure-changing unit for changing pressure of liquid in the nozzle in such a manner that the liquid is ejected from the nozzle; a first level-data setting unit for setting a selected first level data from a plurality of first level data, based on an ejecting data for a first kind of liquid; a second level-data setting unit for setting a selected second level data from a plurality of second level data, based on an ejecting data for a second kind of liquid; a driving-signal generator for generating a driving signal; and a driving-pulse generator for generating a driving pulse based on the selected first or second level data and the driving signal. The plurality of first level data and the plurality of second level data are different from each other.

7 Claims, 10 Drawing Sheets

*Related Art* FIG. 9

| LEVEL VALUE | FIRST PULSE | SECOND PULSE | THIRD PULSE | FOURTH PULSE | DECODED VALUE |
|---|---|---|---|---|---|
| 1 (00) | × | × | × | ○ | (0001) |
| 2 (01) | × | ○ | × | × | (0100) |
| 3 (10) | ○ | × | × | × | (1000) |
| 4 (11) | ○ | × | ○ | × | (1010) |

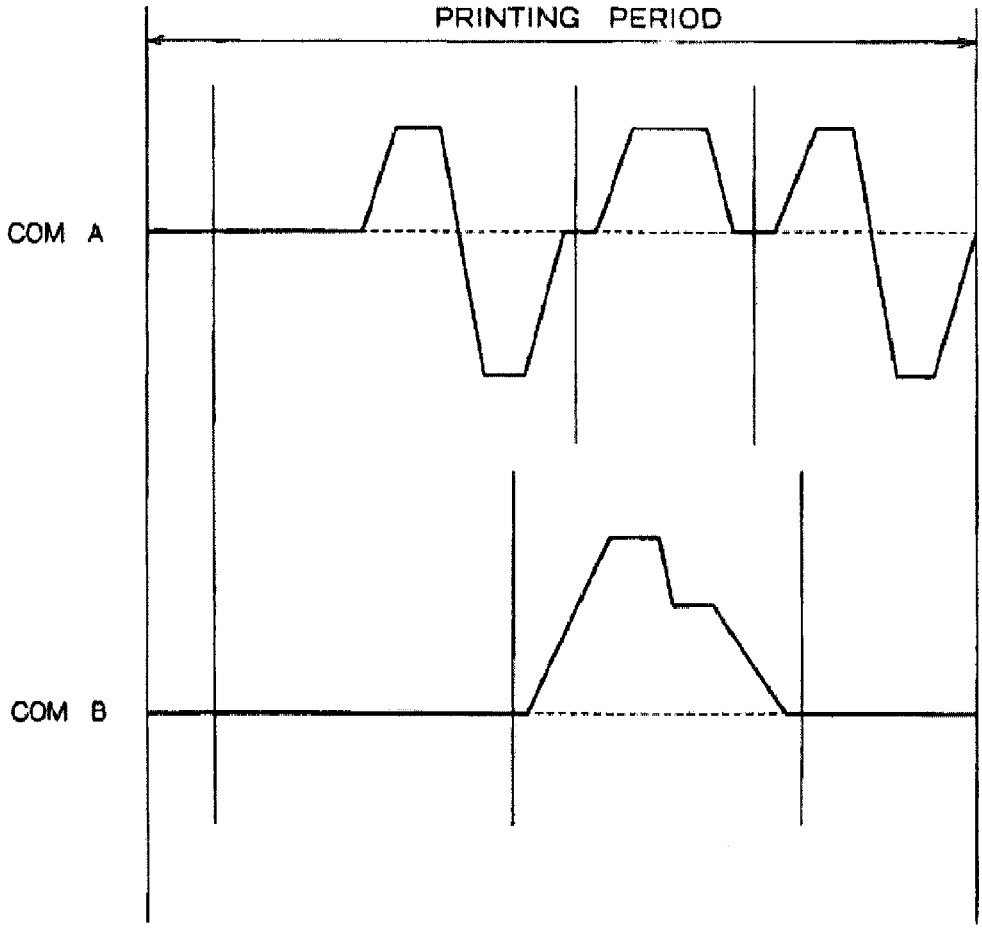
| | | | |
|---|---|---|---|
| NON-RECORDING | A | → | (× × ○ ×) |
| | B | → | (○ ○ × ○) |
| SMALL DOT | A | → | (× × × ×) |
| | B | → | (○ ○ ○ ○) |
| MIDDLE DOT | A | → | (× × × ○) |
| | B | → | (○ ○ × ×) |
| LARGE DOT | A | → | (○ ○ × ○) |
| | B | → | (× × × ×) |
*Related Art* FIG. 11

LIQUID EJECTING APPARATUS DRIVING-SIGNALS GENERATION

FIELD OF THE INVENTION

This invention relates to a liquid ejecting apparatus having a head capable of ejecting a drop of liquid from a nozzle.

BACKGROUND OF THE INVENTION

In an ink-jetting recording apparatus such as an ink-jetting printer or an ink-jetting plotter (a kind of liquid ejecting apparatus), a recording head (head) can move in a main scanning direction, and a recording paper (a kind of recording medium) can move in a sub-scanning direction perpendicular to the main scanning direction. While the recording head moves in the main scanning direction, a drop of ink can be ejected from a nozzle of the recording head onto the recording paper. Thus, an image including a character or the like can be recorded on the recording paper. For example, the drop of ink can be ejected by causing a pressure chamber communicating with the nozzle to expand and/or contract.

The pressure chamber may be caused to expand and/or contract, for example by utilizing deformation of a piezoelectric vibrating member. In such a recording head, the piezoelectric vibrating member can be deformed based on a supplied driving-pulse in order to change a volume of the pressure chamber. When the volume of the pressure chamber is changed, a pressure of the ink in the pressure chamber may be changed. Then, the drop of ink is ejected from the nozzle.

In such a recording apparatus, a driving signal consisting of a series of a plurality of driving-pulses is generated. On the other hand, printing data including level data (gradation data) can be transmitted to the recording head. Then, based on the transmitted printing data, only necessary one or more driving-pulses are selected from the driving signal and supplied to the piezoelectric vibrating member. Thus, a volume of the ink ejected from the nozzle may be changed based on the level data.

In detail, for example, an ink-jetting printer may be used with four level data including: a level data 00 for no dot, a level data 01 for a small dot, a level data 10 for a middle dot and a level data 11 for a large dot. In the case, respective volumes of the ink corresponding to the respective level data may be ejected.

In order to achieve the above four level control, for example, a driving signal as shown in FIG. 8 may be used. As shown in FIG. 8, the driving signal is a periodical signal of a recording period PATA. In one period thereof, the driving signal includes a first pulse signal PAPS1 appearing in a term PAT1, a second pulse signal PAPS2 appearing in a term PAT2 and a third pulse signal PAPS3 appearing in a term PAT3.

In the case, the first pulse signal PAPS1 forms a first driving pulse PADP1, the second pulse signal PAPS2 forms a second driving pulse PADP2, and the third pulse signal PAPS3 forms a third driving pulse PADP3.

The first driving pulse PADP1, the second driving pulse PADP2 and the third pulse signal PAPS3 have a common (the same) waveform. Each of the first driving pulse PADP1, the second driving pulse PADP2 and the third driving pulse PADP3 can eject a drop of the ink alone. That is, when each of the driving pulses is supplied to a piezoelectric vibrating member, a drop of the ink, whose volume corresponds to a small dot, is ejected from a nozzle.

In the case, as shown in FIG. 9, a level (gradation) control can be achieved by increasing or decreasing the number of driving pulses to be supplied to the piezoelectric vibrating member. For example, when a driving pulse is supplied thereto, a small dot may be recorded; when two driving pulses are supplied thereto, a middle dot may be recorded; and when three driving pulses are supplied thereto, a large dot may be recorded.

In addition, a diameter of a dot to be recorded can be variably controlled by changing a waveform of a driving pulse. For example, according to a driving method disclosed in JP Laid-Open Publication No. Hei 10-81012, as shown in FIG. 10, the second pulse corresponding to a recording for a small dot is smaller than the first pulse and the third pulse.

Furthermore, it has been proposed that two driving signals are prepared in advance. For example, as shown in FIG. 11, according to technique disclosed in JP Laid-Open Publication No. 2003-182075, the first driving signal COMA and the second driving signal COMB are used selectively. This technique can make the driving operation much faster.

SUMMARY OF THE INVENTION

As described above, the number of recording (printing) patterns that can be achieved based on the level data consisting of a 2-bit data is four. Usually, as described above, the four patterns are the non-recording, the small-dot, the middle-dot and the large-dot.

However, such four patterns are not superior in graininess.

Specifically, according to the driving method as shown in FIGS. 8 and 9, a weight of an ejected drop of the ink corresponding to the small dot is so large that the recording quality is not good. In addition, the difference between a weight of an ejected drop of the ink corresponding to the middle dot and a weight of an ejected drop of the ink corresponding to the large dot is so large that the graininess is inferior in concentration switching from the middle dot to the large dot and vice versa.

According to the driving method as shown in FIGS. 10 and 11 (see JP Laid-Open Publication No. Hei 10-81012 and JP Laid-Open Publication No. 2003-182075), a weight of an ejected drop of the ink corresponding to the small dot is so small that the recording quality is improved. However, the weight difference between the middle dot and the large dot is still so large that the graininess is still inferior in concentration switching from the middle dot to the large dot and vice versa.

The above tendency appears remarkably in recording an image. Especially, the inventors have found from their study that: it is preferable that a level control with five or more patterns is carried out for two colors of ink (light-cyan and light-magenta) that are called as light-colored inks, for a case of recording with six color inks (black, yellow, cyan, magenta, light-cyan and light-magenta).

The object of this invention is to solve the above problems, that is, to provide a liquid ejecting apparatus such as an ink-jet recording apparatus wherein a level control with five or more patterns can be achieved for only one part of a plurality of kinds of liquid.

In order to achieve the object, a liquid ejecting apparatus includes: a head having a nozzle; a pressure-changing unit for changing pressure of liquid in the nozzle in such a manner that the liquid is ejected from the nozzle; a first level-data setting unit for setting a selected first level data from a plurality of first level data, based on an ejecting data for a first kind of liquid; a second level-data setting unit for setting a selected second level data from a plurality of second level data, based on an ejecting data for a second kind of liquid; a driving-signal generator for generating a driving signal; and a driving-pulse generator for generating a driving pulse based on the selected first or second level data and the driving signal;

wherein the plurality of first level data and the plurality of second level data are different from each other.

According to the above feature, a level control based on the ejecting data for a first kind of liquid and another level control based on the ejecting data for a second kind of liquid can be carried out independently (separately) and differently. Thus, a desired level control with five or more patterns can be achieved for only one part of a plurality of kinds of liquid.

Preferably, each of the plurality of first level data consists of a single 2-bit data, but each of the plurality of second level data consists of sequential two 2-bit data. In the case, any conventional controlling circuit for 2-bit level data may be used while the level control of five or more patterns can be achieved based on the ejecting data for a second kind of liquid. Herein, each of the plurality of second level data may consist of three or more 2-bit data.

Preferably, the ejecting data for a first kind of liquid includes an ejecting data for a black ink, an ejecting data for a cyan ink, an ejecting data for a magenta ink and an ejecting data for a yellow ink; and the ejecting data for a second kind of liquid includes an ejecting data for a light-cyan ink and an ejecting data for a light-magenta ink. That is, it is preferable that a level control for ejecting light-colored inks (light-cyan ink, light-magenta ink) and a level control for ejecting deep-colored inks (back ink, cyan ink, magenta ink, yellow ink) are made different. In particular, it is preferable that the number of patterns of the level control for ejecting light-colored inks is set large.

In addition, preferably, the driving-signal generator is adapted to generate a first driving signal and a second driving signal; the driving-pulse generator is adapted to generate a driving pulse based on the selected first or second level data and the first driving signal and the second driving signal; the first driving signal and the second driving signal are periodical signals having a same period; the first driving signal includes in one period thereof a first large-drop pulse-wave, which is for ejecting a predetermined large drop of the liquid, and a third large-drop pulse-wave, which is for ejecting a predetermined large drop of the liquid; the second driving signal includes in one period thereof a second large-drop pulse-wave, which is for ejecting a predetermined large drop of the liquid; the first large-drop pulse-wave, the second large-drop pulse-wave and the third large-drop pulse-wave have a same waveform; and the first large-drop pulse-wave, the second large-drop pulse-wave and the third large-drop pulse-wave appear in that order at regular intervals.

In the above manner, three waveforms of a so-called "multi-shot signal" are divided into the two driving signals. In addition, the degree of signal change between the two driving signals is uniformized (equalized), so that load of circuit components such as the driving-signal generator can be reduced. Thus, lifetime of the apparatus or the like can be remarkably improved.

In the case, preferably, the second driving signal further includes in one period thereof a small-drop pulse-wave, which is for ejecting a predetermined small drop of the liquid. In the case, a level control of more than four levels can be achieved. In the case too, it is possible to say that the degree of signal change between the two driving signals is uniformized.

More preferably, the second driving signal further includes in one period thereof a middle-drop pulse-wave, which is for ejecting a predetermined middle drop of the liquid. In the case, a level control more superior in graininess can be achieved. In the case too, it is possible to say that the degree of signal change between the two driving signals is uniformized.

In addition, preferably, the first driving signal further includes in one period thereof a micro-vibration pulse-wave, which is for causing a meniscus of the liquid to vibrate minutely without ejecting any drop of the liquid. In the case too, it is possible to say that the degree of signal change between the two driving signals is uniformized.

Alternatively, preferably, the driving-signal generator is adapted to generate a first driving signal and a second driving signal; the driving-pulse generator is adapted to generate a driving pulse based on the selected first or second level data and the first driving signal and the second driving signal; the first driving signal and the second driving signal are periodical signals having a same period; the first driving signal includes in one period thereof a first large-drop pulse-wave, which is for ejecting a predetermined large drop of the liquid; and the second driving signal includes in one period thereof a middle-drop pulse-wave, which is for ejecting a predetermined middle drop of the liquid, and a small-drop pulse-wave, which is for ejecting a predetermined small drop of the liquid.

In the above manner, three waveforms respectively for a small dot, a middle dot and a large dot are divided into the two driving signals. In addition, the degree of signal change between the two driving signals is uniformized (equalized), so that load of circuit components such as the driving-signal generator can be reduced. Thus, lifetime of the apparatus or the like can be remarkably improved.

In the case, preferably, the first driving signal further includes in one period thereof a micro-vibration pulse-wave, which is for causing a meniscus of the liquid to vibrate minutely without ejecting any drop of the liquid. In the case too, it is possible to say that the degree of signal change between the two driving signals is uniformized.

In addition, preferably, the first driving signal further includes in one period thereof a third large-drop pulse-wave, which is for ejecting a predetermined large drop of the liquid; the second driving signal further includes in one period thereof a second large-drop pulse-wave, which is for ejecting a predetermined large drop of the liquid; the first large-drop pulse-wave, the second large-drop pulse-wave and the third large-drop pulse-wave have a same waveform; and the first large-drop pulse-wave, the second large-drop pulse-wave and the third large-drop pulse-wave appear in that order at regular intervals. In the case too, it is possible to say that the degree of signal change between the two driving signals is uniformized.

In a preferable concrete example, when the plurality of first level data include a non-ejecting data, a middle-dot data, a large-dot data and a triple-large-dot data; the driving-pulse generator is adapted to generate, based on the first driving signal and the second driving signal: a driving-pulse including only the micro-vibration pulse-wave when the selected first level data is the non-ejecting data; a driving-pulse including only the middle-drop pulse-wave of the second driving signal when the selected first level data is the middle-dot data; a driving-pulse including only the second large-drop pulse-wave of the second driving signal when the selected first level data is the large-dot data; and a driving-pulse including the first large-drop pulse-wave of the first driving signal, the second large-drop pulse-wave of the second driving signal and the third large-drop pulse-wave of the first driving signal when the selected first level data is the triple-large-dot data; and when the plurality of second level data include a non-ejecting data, a small-dot data, a middle-dot data, a large-dot data, a double-large-dot data and a triple-large-dot data; the driving-pulse generator is adapted to generate, based on the first driving signal and the second driving signal: a driving-pulse including only the micro-vibration pulse-wave when the selected second level data is the non-ejecting data; a driving-pulse including only the small-drop pulse-wave of the second driving signal when the selected second level data is the small-dot data; a driving-pulse including only the middle-drop pulse-wave of the second driving signal when the selected second level data is the middle-dot data; a driving-pulse including only the second large-drop pulse-wave of the second driving signal when the selected second level data is the large-dot data; a driving-pulse including the first large-drop pulse-wave of the first driving signal and the third large-drop pulse-wave of the first driving signal when the selected second level data is the double-large-dot data; and a driving-pulse including the first large-drop pulse-wave of the first driving signal, the second large-drop pulse-wave of the second driving signal and the third large-drop pulse-wave of the first driving signal when the selected second level data is the triple-large-dot data.

BRIEF DESCRIPTION OF THE DRAWINGS

FIG. 11 is a diagram of an example of two driving signals.

BEST MODE FOR CARRYING OUT THE INVENTION

An embodiment of the invention will now be described in more detail with reference to drawings.

Figure 1:
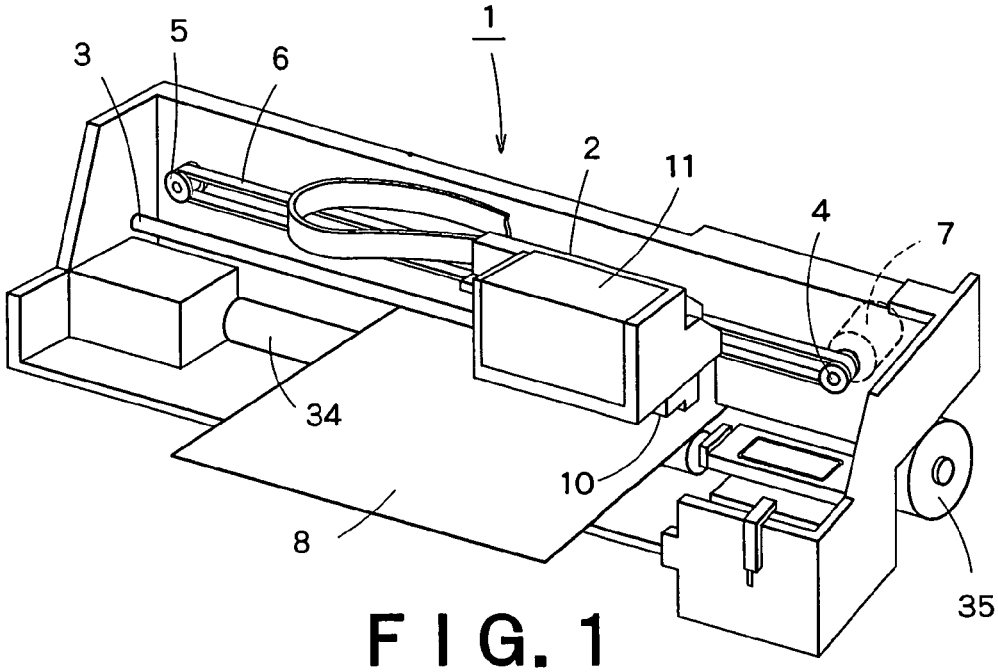
FIG. 1 is a schematic perspective view of an ink-jetting printer of an embodiment according to the invention.

FIG. 1 is a schematic perspective view of an ink-jetting printer 1 as a liquid ejecting apparatus of a first embodiment according to the invention. In the ink-jetting printer 1, a carriage 2 is slidably mounted on a guide bar 3. The carriage 2 is connected to a timing belt 6, which goes around a driving pulley 4 and a free pulley 5. The driving pulley 4 is connected to a rotational shaft of a pulse motor 7. Thus, the carriage 2 can be reciprocated along a direction of width of a recording paper 8 by driving the pulse motor 7 (main scanning).

A recording head (head) 10 is mounted under the carriage 2. The recording head 10 mounted under the carriage 2 is adapted to face down to the recording paper 8.

Figure 2:
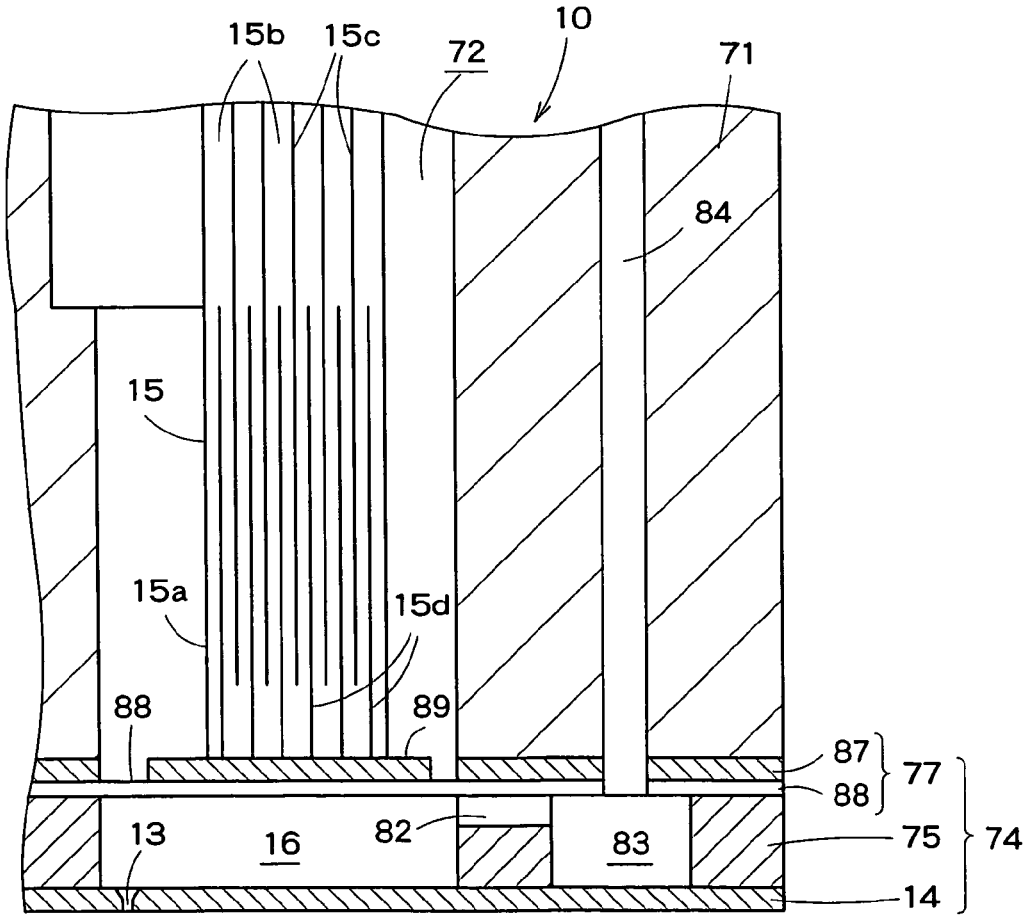
FIG. 2 is a sectional view of an example of a recording head.

As shown in FIG. 2, the recording head 10 has a plastic box-like case 71 defining a housing room 72. The longitudinal-mode piezoelectric vibrating unit 15 has a shape of teeth of a comb, and is inserted in the housing room 72 in such a manner that points of teeth-like portions 15*a* of the piezoelectric vibrating unit 15 are aligned at an opening of the housing room 72. A ink-way unit 74 is bonded on a surface of the case 71 on the side of the opening of the housing room 72. The points of the teeth-like portions 15*a* are fixed at predetermined positions of the ink-way unit 74 to function as piezoelectric vibrating members respectively.

The piezoelectric vibrating unit 15 comprises a plurality of piezoelectric layers 15*b*. As shown in FIG. 2, common inside electrodes 15*c* and individual inside electrodes 15*d* are inserted alternately between each adjacent two of the piezoelectric layers 15*b*. The piezoelectric layers 15*b*, the common inside electrodes 15*c* and the individual inside electrodes 15*d* are integrated and cut into the shape of the teeth of the comb. Thus, when a voltage is applied between the common inside electrodes 15*c* and an individual inside electrode 15*d*, a piezoelectric vibrating member contracts in a longitudinal direction of each of the piezoelectric layers 15*b*.

The ink-way unit 74 consists of a nozzle plate 16, an elastic plate 77 and an ink-way forming plate 75 sandwiched between the nozzle plate 14 and the elastic plate 77. The nozzle plate 14, the ink-way forming plate 75 and the elastic plate 77 are integrated as shown in FIG. 2.

A plurality of nozzles 13 is formed in the nozzle plate 14. A plurality of pressure generating chambers 16, a plurality of ink-supplying ways 82 and a common ink-chamber 83 are formed in the ink-way forming plate 75. Each of the pressure chambers 16 is defined by partition walls, and is communicated with a corresponding nozzle 13 at an end portion thereof and with a corresponding ink-supplying way 82 at the other end portion thereof. The common ink-chamber 83 is communicated with all the ink-supplying ways 82, and has a longitudinal shape. For example, the longitudinal common ink-chamber 83 may be formed by an etching process when the ink-way forming plate 75 is a silicon wafer. Then, the pressure chambers 16 are formed in the longitudinal direction of the common ink-chamber 83 at the same intervals (pitches) as nozzles 13. Then, a groove as an ink-supplying way 82 is formed between each of the pressure chambers 16 and the common ink-chamber 83. In the case, the ink-supplying way 82 is connected to an end of the pressure chamber 16, while the nozzle 13 is located near the other end of the pressure chamber 16. The common ink-chamber 83 is adapted to supply ink saved in an ink cartridge to the pressure chambers 16. An ink-supplying tube 84 from the ink cartridge is communicated with a middle portion of the common ink-chamber 83.

The elastic plate 77 is layered on a surface of the ink-way forming plate 75 opposed to the nozzle plate 14. In the case, the elastic plate 77 consists of two laminated layers that are a stainless plate 87 and an elastic high-polymer film 88 such as a PPS film. The stainless plate 87 is provided with island portions 89 for fixing the teeth-like portions 15*a* as the piezoelectric vibrating members 15 in respective portions corresponding to the pressure chambers 16, by an etching process.

In the above recording head 10, a tooth-like portion 15*a* as a piezoelectric vibrating member can expand in the longitudinal direction. Then, an island portion 89 is pressed toward the nozzle plate 14, the elastic film 88 is deformed. Thus, a corresponding pressure chamber 16 contracts. On the other hand, the tooth-like portion 15*a* as the piezoelectric vibrating member can contract from the expanding state in the longitudinal direction. Then, the elastic film 88 is returned to the original state owing to elasticity thereof. Thus, the corresponding pressure chamber 16 expands. By causing the pressure chamber 16 to expand and then causing the pressure chamber 16 to contract, a pressure of the ink in the pressure chamber 16 increases so that the ink drop is ejected from a nozzle 13.

That is, in the above recording head 10, when a tooth-like portion 15*a* as a piezoelectric vibrating member is charged or discharged, the volume of the corresponding pressure chamber 16 is also changed. Thus, by using the change of the volume of the pressure chamber 16, the pressure of the ink in the pressure chamber 16 can be changed, so that a drop of the ink can be ejected from the corresponding nozzle 13 or a meniscus at the corresponding nozzle 13 can be minutely vibrated. The meniscus means a free surface of the ink exposed at an opening of the nozzle 13.

Instead of the above longitudinal-mode piezoelectric vibrating unit 15, bending-mode piezoelectric vibrating members can be used. When a bending-mode piezoelectric vibrating member is used, a charging operation causes a pressure chamber to contract, and a discharging operation causes the pressure chamber to expand. When the bending-mode piezoelectric vibrating member is used, compared with the case wherein the longitudinal-mode piezoelectric vibrating member 15 is used, the rising and the falling of a waveform described below are opposite (positive and negative are opposite).

Preferably, the recording head 10 is a many-color-recording head that is capable of recording with a different plurality of colors. Thus, the recording head 10 has a plurality of head units. Respective predetermined colors are set for and used in the plurality of head units, respectively.

The recording head 10 of the present embodiment may have six head units, i.e., a black head unit capable of ejecting a drop of black ink, a cyan head unit capable of ejecting a drop of cyan ink, a light-cyan head unit capable of ejecting a drop of light-cyan ink, a magenta head unit capable of ejecting a drop of magenta ink, a light-magenta head unit capable of ejecting a drop of light-magenta ink, and a yellow head unit capable of ejecting a drop of yellow ink.

In the printer 1 as described above, a drop of the ink may be ejected from the recording head 10 synchronously with the main scanning of the carriage 2, during a recording operation. A platen 34 may be rotated synchronously with the reciprocation of the carriage 2 so that the recording paper 8 is fed in a feeding (sub-scanning) direction. As a result, an image including characteristics or the like is recorded on the recording paper 8, based on recording data.

Figure 3:
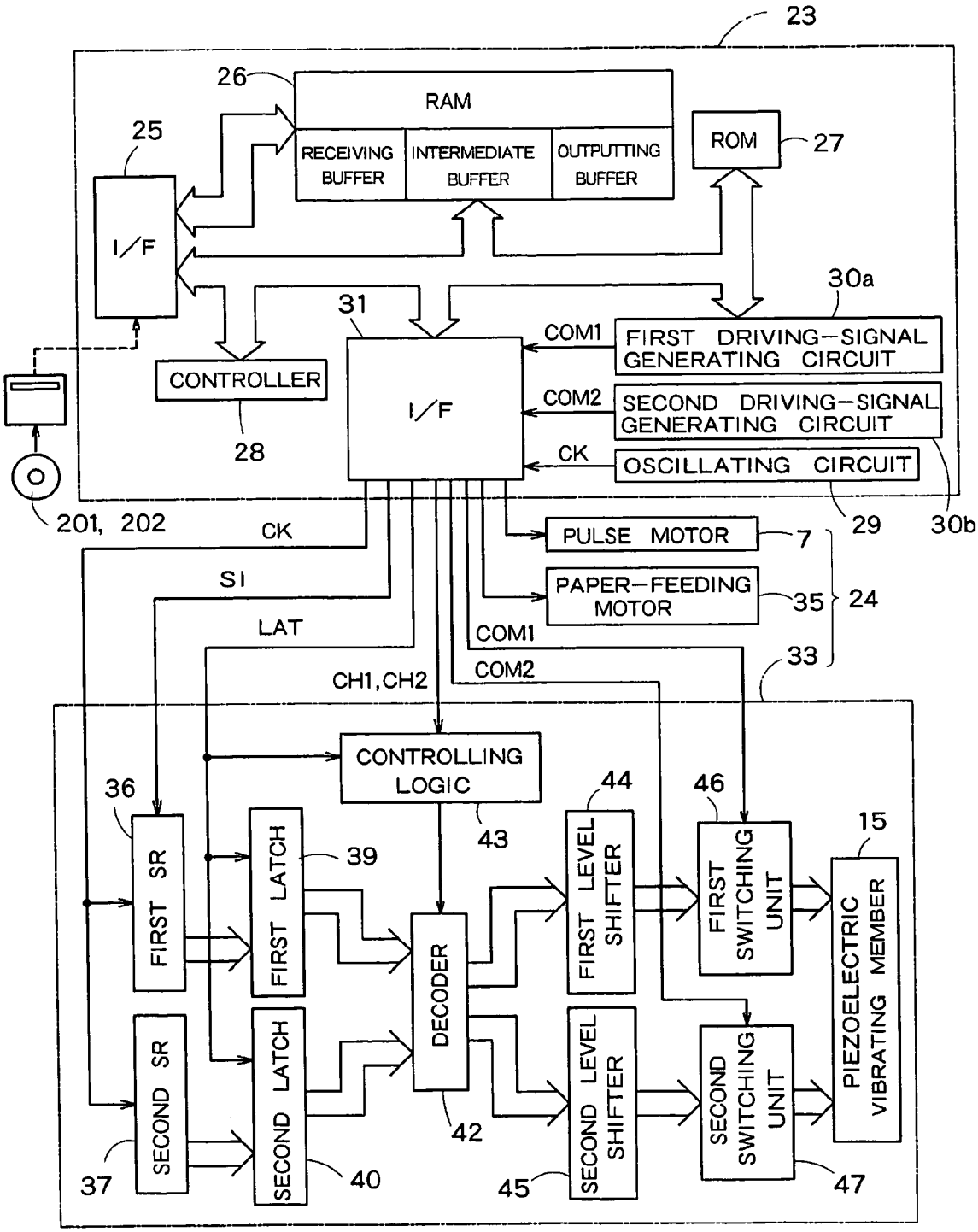
FIG. 3 is a schematic block diagram for explaining an electric structure of the ink-jetting printer.

Then, an electric structure of the ink-jetting printer 1 is explained. As shown in FIG. 3, the printer 1 has a printer controller 23 and a printing engine 24.

The printer controller 23 has: an outside interface (outside I/F) 25; a RAM 26 for temporarily storing various data; a ROM 27 storing a controlling program or the like; a main controller 28 including a CPU or the like; a oscillating circuit 29 for generating a clock signal (CK); a first driving-signal generating circuit 30*a* for generating a first driving signal (COM1) for supplying to the recording head 10; a second driving-signal generating circuit 30*b* for generating a second driving signal (COM2) for supplying to the recording head 10; and an inside interface (inside I/F) 31 for transmitting the driving signals, dot pattern data (bit map data) developed based on printing data (recording data) or the like to the printing engine 24.

The outside I/F 25 is adapted to receive the printing data consisting of character codes, graphic functions, image data or the like, from a host computer (not shown) or the like. In addition, the outside I/F 25 is adapted to output a busy signal (BUSY) and/or an acknowledge signal (ACK) to the host computer or the like.

The RAM 26 has a receiving buffer, an intermediate buffer, an outputting buffer and a work memory (not shown). The receiving buffer can temporarily store the printing data received via the outside I/F 25. The intermediate buffer can store intermediate code data converted by the main controller 28. The outputting buffer can store dot pattern data. The dot pattern data mean printing data obtained by decoding (translating) the intermediate code data.

The ROM 27 stores font data, graphic functions or the like as well as the controlling program for conducting various data processing.

The main controller 28 is adapted to conduct various controls according to the controlling program stored in the ROM 27. For example, the main controller 28 reads out the printing data in the receiving buffer, converts the printing data into the intermediate code data, and causes the intermediate buffer to store the intermediate code data. In addition, the main controller 28 analyzes the intermediate code data read out from the intermediate buffer, and develops (decodes) the intermediate code data into the dot pattern data with reference to the font data and the graphic functions or the like stored in the ROM 27. Then, the main controller 28 conducts necessary decoration processes to the dot pattern data, and causes the outputting buffer to store the dot pattern data. Each of the dot pattern data functions as level data (printing data). In the present embodiment, each of the dot pattern data for the light-colored inks (light-cyan ink, light-magenta ink) consists of sequential two 2-bit data (including dummy 1-bit). On the other hand, each of the dot pattern data for the deep-colored inks (black ink, cyan ink, magenta ink, yellow ink) consists of a single 2-bit data. As described above, the main controller 28 may function as a level-data setting unit.

After dot pattern data for one line, which correspond to one main scanning of the recording head 10, are obtained, the dot pattern data for the one line is outputted in turn from the outputting buffer to the recording head 10 via the inside I/F 31. When the dot pattern data for the one line is outputted from the outputting buffer, the intermediate code data that have already been developed are erased from the intermediate buffer. Then, the next intermediate code data start to be developed.

In addition, the main controller 28 may function as a part of timing signal generating unit, that is, supply latch signals (LAT) and/or channel signals (CH) to the recording head 10 via the inside I/F 31. The latch signals and/or the channel signals define starting timings for supplying driving pulses, each of which forms a part of the first driving signal (COM1) or the second driving signal (COM2).

However, the printing engine 24 has: a paper-feeding motor 35 as a paper-feeding mechanism; the pulse motor 7 as a carriage-moving mechanism; and an electric driving system 33 for the recording head 10. The paper-feeding motor 35 causes the platen 34 (see FIG. 1) to rotate in order to feed the recording paper 8. The pulse motor 7 causes the carriage 2 to move via the timing belt 6.

As shown in FIG. 3, the electric driving system 33 for the recording head 10 has: a shift-register circuit consisting of a first shift-register 36 and a second shift-register 37; a latch circuit consisting of a first latch-circuit 39 and a second latch-circuit 40; a decoder 42; a controlling logic circuit 43; a first level shifter 44 and a second level shifter 45; a first switching circuit 46 and a second switching circuit 47; and the piezoelectric vibrating members 15.

Figure 4:
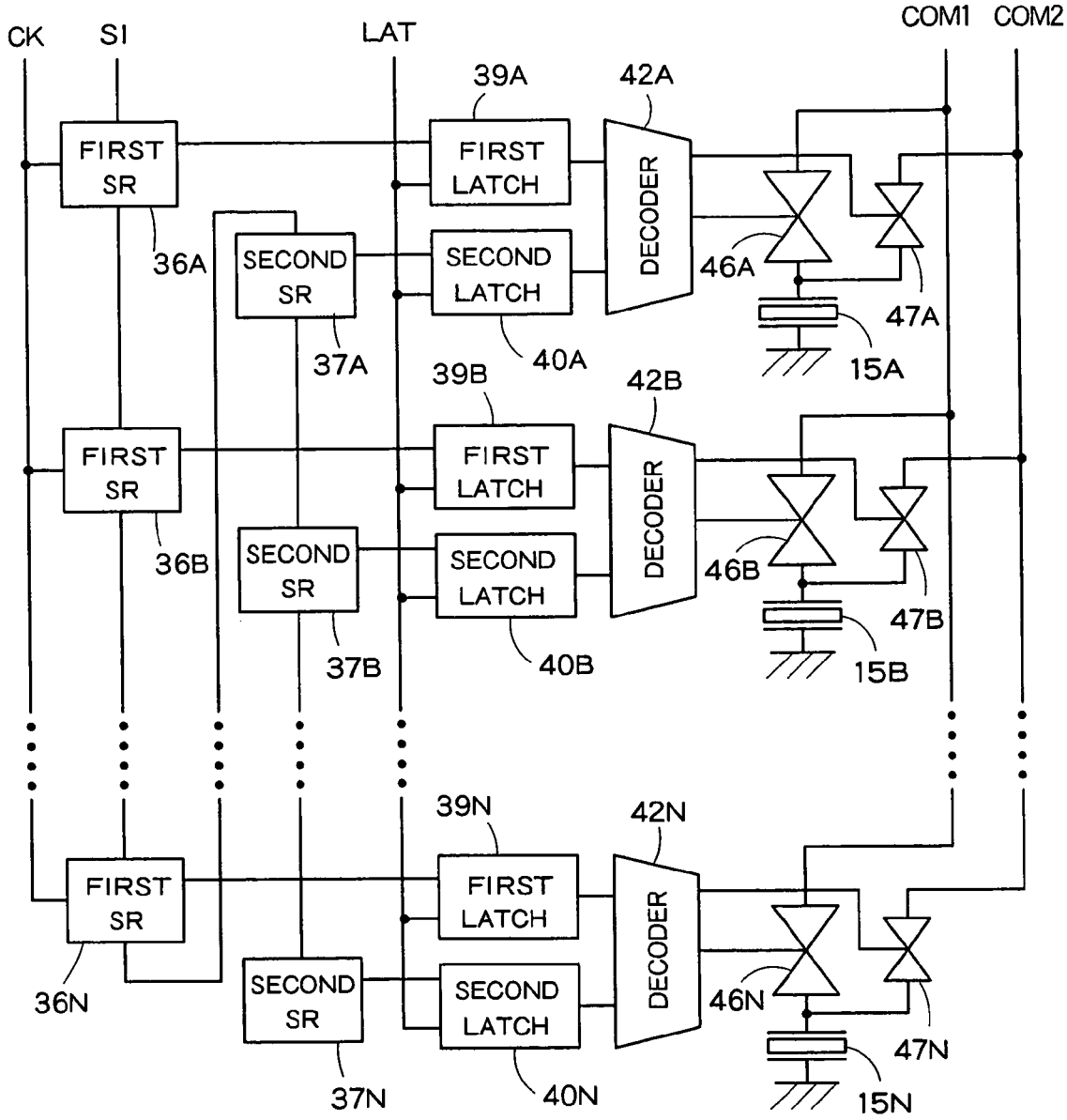
FIG. 4 is a schematic block diagram for explaining an electric driving structure of the recording head.

As shown in FIG. 4, the first shift-register 36 has a plurality of first shift-register devices 36A to 36N, each of which corresponds to each of the nozzles 13 of the recording head 10. Similarly, the second shift-register 37 has a plurality of second shift-register devices 37A to 37N, each of which corresponds to each of the nozzles 13 of the recording head 10. The first latch-circuit 39 has a plurality of first latch-circuit devices 39A to 39N, each of which corresponds to each of the nozzles 13 of the recording head 10. Similarly, the second latch-circuit 40 has a plurality of second latch-circuit devices 40A to 40N, each of which corresponds to each of the nozzles 13 of the recording head 10. The decoder 42 has a plurality of decoder devices 42A to 42N, each of which corresponds to each of the nozzles 13 of the recording head 10. The first switching circuit 46 has a plurality of first switching circuit devices 46A to 46N, each of which corresponds to each of the nozzles 13 of the recording head 10. Similarly, the second switching circuit 47 has a plurality of second switching circuit devices 47A to 47N, each of which corresponds to each of the nozzles 13 of the recording head 10. Each of the piezoelectric vibrating members 35 corresponds to each of the nozzles 13. Thus, the piezoelectric vibrating members 35 are also designated as piezoelectric vibrating members 35A to 35N.

According to the electric driving system 33, the recording head 10 can eject a drop of the ink, based on the level data from the printer controller 23. The level data (SI) from the printer controller 23 are transmitted in a serial manner to the first shift-register 36 and the second shift-register 37 via the inside I/F 31, synchronously with the clock signal (CK) from the oscillating circuit 29.

Herein, the level data for the deep-colored inks from the printer controller 23 (first level data) are data consisting of a single 2-bit as described above. In detail, four levels consisting of no recording, a middle dot, a large dot and a triple-large dot are represented by the single 2-bit data. That is, the level data of no recording is represented by "(00)", the level data of the middle dot is represented by "(01)", the level data of the large dot is represented by "(10)", and the level data of the triple-large dot is represented by "(11)".

The level data is set for each of printing dots, that is, each of the nozzles 13. Then, the lower bits of the level data for all the nozzles 13 are inputted in the first shift-register devices 36A to 36N, respectively. Similarly, the upper bits of the level data for all the nozzles 13 are inputted in the second shift-register devices 37A to 37N, respectively.

As shown in FIGS. 3 and 4, the first shift-register devices 36A to 36N are electrically connected to the first latch-circuit devices 39A to 39N, respectively. Similarly, the second shift-register devices 37A to 37N are electrically connected to the second latch-circuit devices 40A to 40N, respectively. When the latch signals (LAT) from the printer controller 23 are inputted to the first and the second latch-circuit devices 39A to 39N and 40A to 40N, the first latch-circuit devices 39A to 39N latch the lower bits of former half 2-bit of the level data, and the second latch-circuit devices 40A to 40N latch the upper bits of former half 2-bit of the level data, respectively.

As described above, a circuit unit consisting of the first shift-register 36 and the first latch-circuit 39 may function as a storing circuit. Similarly, a circuit unit consisting of the second shift-register 36 and the second latch-circuit 39 may also function as a storing circuit. That is, these storing circuits can temporarily store the former half 2-bit of the level data before inputted to the decoder 42.

On the other hand, the level data for the light-colored inks from the printer controller 23 (second level data) are data consisting of sequential two 2-bits as described above. In detail, six levels consisting of no recording, a small dot, a middle dot, a large dot, a double-large dot and a triple-large dot are represented by the two 2-bit data. That is, the level data of no recording is represented by "(00)(00)", the level data of the small dot is represented by "(01)(00)", the level data of the middle dot is represented by "(00)(01)", the level data of the large dot is represented by "(00)(10)", the level data of the double-large dot is represented by "(01)(01)", and the level data of the triple-large dot is represented by "(00)(11)". Herein, the double-large dot is formed by two pulses, each of which may be used for a large dot, and the triple-large dot is formed by three pulses, each of which may be used for a large dot. That is, the "double" doesn't means twice in a signal voltage, and the "triple" doesn't means three times in a signal voltage.

The level data is set for each of printing dots, that is, each of the nozzles 13. Then, the lower bits of former half 2-bit of the level data for all the nozzles 13 are inputted in the first shift-register devices 36A to 36N, respectively. Similarly, the upper bits of former half 2-bit of the level data for all the nozzles 13 are inputted in the second shift-register devices 37A to 37N, respectively. Herein, in the present embodiment, the upper bits of former half 2-bit of the level data are always "0", that is, they are dummy data bits.

As shown in FIGS. 3 and 4, the first shift-register devices 36A to 36N are electrically connected to the first latch-circuit devices 39A to 39N, respectively. Similarly, the second shift-register devices 37A to 37N are electrically connected to the second latch-circuit devices 40A to 40N, respectively. When the latch signals (LAT) from the printer controller 23 are inputted to the first and the second latch-circuit devices 39A to 39N and 40A to 40N, the first latch-circuit devices 39A to 39N latch the lower bits of former half 2-bit of the level data, and the second latch-circuit devices 40A to 40N latch the upper bits of former half 2-bit of the level data, respectively.

As described above, a circuit unit consisting of the first shift-register 36 and the first latch-circuit 39 may function as a storing circuit. Similarly, a circuit unit consisting of the second shift-register 36 and the second latch-circuit 39 may also function as a storing circuit. That is, these storing circuits can temporarily store the former half 2-bit of the level data before inputted to the decoder 42.

Next, the lower bits of latter half 2-bit of the level data for all the nozzles 13 are inputted in the first shift-register devices 36A to 36N, respectively. Similarly, the upper bits of latter half 2-bit of the level data for all the nozzles 13 are inputted in the second shift-register devices 37A to 37N, respectively.

Then, in the same manner as the above process to the former half 2-bit of the level data, when the next latch signals (LAT) from the printer controller 23 are inputted to the first and the second latch-circuit devices 39A to 39N and 40A to 40N, the first latch-circuit devices 39A to 39N latch the lower bits of latter half 2-bit of the level data, and the second latch-circuit devices 40A to 40N latch the upper bits of latter half 2-bit of the level data, respectively. That is, sequential two latch signals are used for one control for each dot (each pixel).

The bit data latched in the latch-circuits 39 and 40 are supplied to the decoder 42, that is, the decoder devices 42A to 42N. The respective decoder devices 42A to 42N decode (translate) the level data consisting of the sequential two 2-bits into first pulse-selecting data and second pulse-selecting data. In the present embodiment, each of the first and second pulse-selecting data has five bits, each of the five bits corresponding to a pulse-wave forming a part of the first driving signal (COM1) and/or a pulse-wave forming a part of the second driving signal (COM2). Then, depending on each of the bits of the pulse selecting data ("0" or "1"), each of the pulse-waves may be supplied or not to the piezoelectric vibrating member 15. The driving signals (COM1. COM2) and the pulse-waves will be described in detail hereafter.

In addition, timing signals from the controlling logic circuit 43 are also inputted to the decoder 42 (decoder devices 42A to 42N). The controlling logic circuit 43 may function as a timing-signal generator together with the main controller 28, in order to generate the timing signals based on the latch signals (LAT) and the channel signals (CH1, CH2).

The first pulse-selecting data translated by the decoder 42 (decoder devices 42A to 42N) are inputted to the first level shifter 44 (respective first level shifter devices 44A to 44N) in turn from an uppermost bit thereof to a lowermost bit thereof at respective timings defined by the timing signals. For example, the uppermost bit of the first pulse-selecting data is inputted to the first level shifter 44 at the first timing of a recording period, and the second uppermost bit of the first pulse-selecting data is inputted to the first level shifter 44 at the second timing.

Similarly, the second pulse-selecting data translated by the decoder 42 (decoder devices 42A to 42N) are inputted to the second level shifter 45 (respective second level shifter devices 45A to 45N) in turn from an uppermost bit thereof to a lowermost bit thereof at respective timings defined by the timing signals. For example, the uppermost bit of the second pulse-selecting data is inputted to the second level shifter 45 at the first timing of a recording period, and the second uppermost bit of the second pulse-selecting data is inputted to the second level shifter 45 at the second timing.

Each of the first level shifter 44 and the second level shifter 45 is adapted to function as a voltage amplifier. For example, when a bit of the first or second pulse-selecting data is "1", the first level shifter 44 or the second level shifter 45 raises the datum "1" to a voltage of several decade volts that can drive the first switching circuit 46 (respective first switching circuit devices 46A to 46N) or the second switching circuit 47 (respective second switching circuit devices 47A to 47N).

The datum raised by the first level shifter 44 is applied to the first switching circuit 46, which may function as a driving-pulse generator. That is, the first switching circuit 46 selects and generates one or more driving pulses from the first driving signal (COM1), based on the first pulse-selecting data generated by translating the printing data. The generated one or more driving pulses are supplied to the piezoelectric vibrating member 15. For the purpose, input terminals of the first switching circuit devices 46A to 46N are adapted to be supplied the first driving signal (COM1) from the first driving-signal generator 30*a*, and output terminals of the first switching circuit devices 46A to 46N are connected to the piezoelectric vibrating members 35A to 35N, respectively.

Each of the first switching devices 46A to 46N is controlled by the first pulse-selecting data. That is, a first switching device of 46A to 46N is closed (connected) when a bit of the first pulse-selecting data is 1. Then, the corresponding driving pulse is supplied to the corresponding piezoelectric vibrating member 15. Thus, an electric-potential level of the piezoelectric vibrating member 15 is changed.

On the other hand, when a bit of the first pulse-selecting data is "0", a first level shifter device of 44A to 44N does not output an electric signal for operating the corresponding first switching circuit device of 46A to 46N. Then, the first switching circuit device is not connected, so that the corresponding driving pulse (pulse-wave) is not supplied to the corresponding piezoelectric vibrating member 15.

In addition, the datum raised by the second level shifter 45 is applied to the second switching circuit 47, which may function as a driving-pulse generator. That is, the second switching circuit 47 selects and generates one or more driving pulses from the second driving signal (COM2), based on the second pulse-selecting data generated by translating the printing data. The generated one or more driving pulses are supplied to the piezoelectric vibrating member 15. For the purpose, input terminals of the second switching circuit devices 47A to 47N are adapted to be supplied the second driving signal (COM2) from the second driving-signal generator 30*b*, and output terminals of the second switching circuit devices 47A to 47N are connected to the piezoelectric vibrating members 35A to 35N, respectively.

Each of the second switching devices 47A to 47N is controlled by the second pulse-selecting data. That is, a second switching device of 47A to 47N is closed (connected) when a bit of the second pulse-selecting data is 1. Then, the corresponding driving pulse is supplied to the corresponding piezoelectric vibrating member 15. Thus, an electric-potential level of the piezoelectric vibrating member 15 is changed.

On the other hand, when a bit of the second pulse-selecting data is "0", a second level shifter device of 45A to 45N does not output an electric signal for operating the corresponding second switching circuit device of 47A to 47N. Then, the second switching circuit device is not connected, so that the corresponding driving pulse (pulse-wave) is not supplied to the corresponding piezoelectric vibrating member 15.

Next, the first driving signal (COM1) generated by the first driving-signal generator 30*a*, the second driving signal (COM2) generated by the second driving-signal generator 30*b*, and a control of ejecting one or more drops of the ink by means of the two driving signals are explained in detail.

Figure 5:
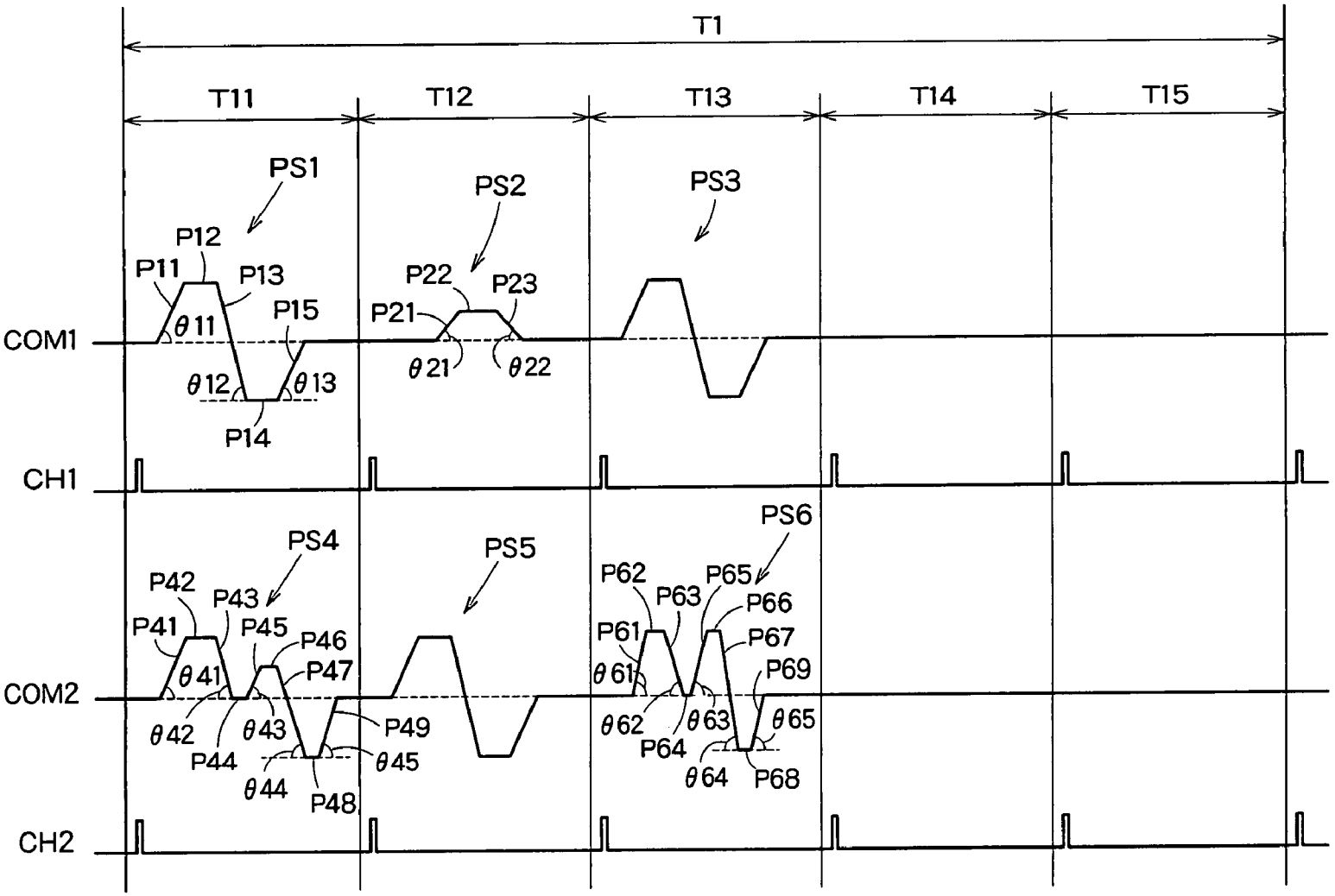
FIG. 5 is a diagram of an example of two driving signals.

As shown in FIG. 5, the first driving signal COM1 is a periodical signal having a recording period T1. The recording period T1 is divided into a part T11 including a first pulse-wave PS1, a part T12 including a second pulse-wave PS2, a part T13 including a third pulse-wave PS3, a part T14, and a part 15. The first pulse-wave PS1, the second pulse-wave PS2 and the third pulse-wave PS3 are connected in a series manner. In the case, the part (term) T11, the part T12 and the part T13 have the same length. The part T14 and the part T15 have no pulse-wave, and may be used as adjustment elements, for example.

The first pulse-wave PS1 and the third pulse-wave PS3 have a common wave-pattern (waveform). Each of the first pulse-wave PS1 and the third pulse-wave PS3 is a signal capable of ejecting a large drop of the ink alone.

That is, each of the first pulse-wave PS1 and the third pulse-wave PS3 includes: a first charging element P11 rising from a middle electric potential VM to a highest electric potential VH at an incline θ11, a first holding element P12 maintaining the highest electric potential VH for a very short time, a first discharging element P13 falling from the highest electric potential VH to a lowest electric potential VL at a steep incline θ12 within a very short time, a second holding element P14 maintaining the lowest electric potential VL for a time, and a second charging element P15 rising from the lowest electric potential VL to the middle electric potential VM at an incline θ13.

When each of the first pulse-wave PS1 and the third pulse-wave PS3 is supplied to the piezoelectric vibrating member 15, a large drop of the ink, whose volume corresponds to about 7 pl, is ejected from the nozzle 13.

In detail, when the first charging element P11 is supplied to the piezoelectric vibrating member 15, the piezoelectric vibrating member 15 is charged from the middle electric potential VM. Then, the corresponding pressure chamber 16 is caused to expand from a standard volume thereof to a maximum volume thereof. Then, by the first discharging element P13, the pressure chamber 16 is caused to rapidly contract to a minimum volume thereof. Such a contracting state of the pressure chamber 16 is maintained while the second holding element P14 is supplied to the piezoelectric vibrating member 15. The rapid contraction and the keeping of the contracting state of the pressure chamber 16 raise a pressure of the ink in the pressure chamber 16 so rapidly that a drop of the ink is ejected from the nozzle 13. A volume of the ejected drop of the ink is about 7 pl. Then, by the second charging element P15, the pressure chamber 16 is caused to expand back to an original state thereof in order to settle down a vibration of a meniscus of the ink at the nozzle 13 within a short time.

The second pulse-wave PS2 is a signal capable of causing a meniscus of the ink in the nozzle 13 to vibrate minutely without ejecting any drop of the ink.

That is, the second pulse-wave PS2 includes: a first charging element P21 rising from the middle electric potential VM to a second highest electric potential VH2 (<VH) at an incline θ21, a first holding element P22 maintaining the second highest electric potential VH2 for a very short time, a first discharging element P23 falling from the second highest electric potential VH2 to the middle electric potential VM at an incline θ22.

When the second pulse-wave PS2 is supplied to the piezoelectric vibrating member 15, a meniscus of the ink in the nozzle 13 vibrates minutely.

On the other hand, as shown in FIG. 5, the second driving signal COM2 is also a periodical signal of the recording period T1. The second driving signal COM2 includes a fourth pulse-wave PS4 arranged in the term T11, a fifth pulse-wave PS5 arranged in the term T12 and a sixth pulse-wave PS6 arranged in the term T13. The fourth pulse-wave PS4, the fifth pulse-wave PS5 and the sixth pulse-wave PS6 are connected in a series manner.

The fourth pulse-wave PS4 is a signal capable of ejecting a middle drop of the ink.

That is, the fourth pulse-wave PS4 includes: a first charging element P41 rising from the middle electric potential VM to the highest electric potential VH at an incline θ41, a first holding element P42 maintaining the highest electric potential VH for a very short time, a first discharging element P43 falling from the highest electric potential VH to the middle electric potential VM at an incline θ42 within a short time, a second holding element P44 maintaining the middle electric potential VM for a time, a second charging element P45 rising from the middle electric potential VM to the second highest electric potential VH2 (<VH) at an incline θ43, a third holding element P46 maintaining the second highest electric potential VH2 for a time, a second discharging element P47 falling from the second highest electric potential VH2 to the lowest electric potential VL at an incline θ44, a third holding element P48 maintaining the lowest electric potential VL for a time, and a third charging element P49 rising from the lowest electric potential VL to the middle electric potential VM at an incline θ45.

When the fourth pulse-wave PS4 is supplied to the piezoelectric vibrating member 15, a middle drop of the ink, whose volume corresponds to about 3 pl, is ejected from the nozzle 13.

In detail, when the first charging element P41 is supplied to the piezoelectric vibrating member 15, the piezoelectric vibrating member 15 is charged from the middle electric potential VM. Then, the corresponding pressure chamber 16 is caused to expand from a standard volume thereof to a maximum volume thereof. Then, by the first discharging element P43, the pressure chamber 16 is caused to contract. Such a contracting state of the pressure chamber 16 is maintained while the second holding element P44 is supplied to the piezoelectric vibrating member 15. The contraction and the keeping of the contracting state of the pressure chamber 16 raise a pressure of the ink in the pressure chamber 16 so rapidly that a drop of the ink is ejected from the nozzle 13. A volume of the ejected drop of the ink is about 3 pl. Then, by the second charging element P45 to the third charging element P49, vibration of a meniscus of the ink at the nozzle 13 can be settled down within a short time.

The fifth pulse-wave PS5 has the same wave-pattern (waveform) as those of the first pulse-wave PS1 and the third pulse-wave PS3. When the fifth pulse-wave PS5 is supplied to the piezoelectric vibrating member 15, a large drop of the ink, whose volume corresponds to about 7 pl, is ejected from the nozzle 13.

The sixth pulse-wave PS6 is a signal capable of ejecting a small drop of the ink.

That is, the sixth pulse-wave PS6 includes: a first charging element P61 rising from the middle electric potential VM to the highest electric potential VH at an incline θ61, a first holding element P62 maintaining the highest electric potential VH for a very short time, a first discharging element P63 falling from the highest electric potential VH to the middle electric potential VM at an incline θ62 within a short time, a second holding element P64 maintaining the middle electric potential VM for a time, a second charging element P65 rising from the middle electric potential VM to the highest electric potential VH at an incline θ63, a third holding element P66 maintaining the highest electric potential VH for a time, a second discharging element P67 falling from the highest electric potential VH to the lowest electric potential VL at an incline θ64, a third holding element P68 maintaining the lowest electric potential VL for a time, and a third charging element P69 rising from the lowest electric potential VL to the middle electric potential VM at an incline θ65.

When the sixth pulse-wave PS6 is supplied to the piezoelectric vibrating member 15, a small drop of the ink, whose volume corresponds to about 1.5 pl, is ejected from the nozzle 13.

In detail, when the first charging element P61 is supplied to the piezoelectric vibrating member 15, the piezoelectric vibrating member 15 is charged from the middle electric potential VM. Then, the corresponding pressure chamber 16 is caused to expand from a standard volume thereof to a maximum volume thereof. Then, by the first discharging element P63, the pressure chamber 16 is caused to contract. Such a contracting state of the pressure chamber 16 is maintained while the second holding element P64 is supplied to the piezoelectric vibrating member 15. The contraction and the keeping of the contracting state of the pressure chamber 16 raise a pressure of the ink in the pressure chamber 16 so rapidly that a drop of the ink is ejected from the nozzle 13. A volume of the ejected drop of the ink is about 1.5 pl. Then, by the second charging element P65 to the third charging element P69, vibration of a meniscus of the ink at the nozzle 13 can be settled down within a short time.

Figure 6:
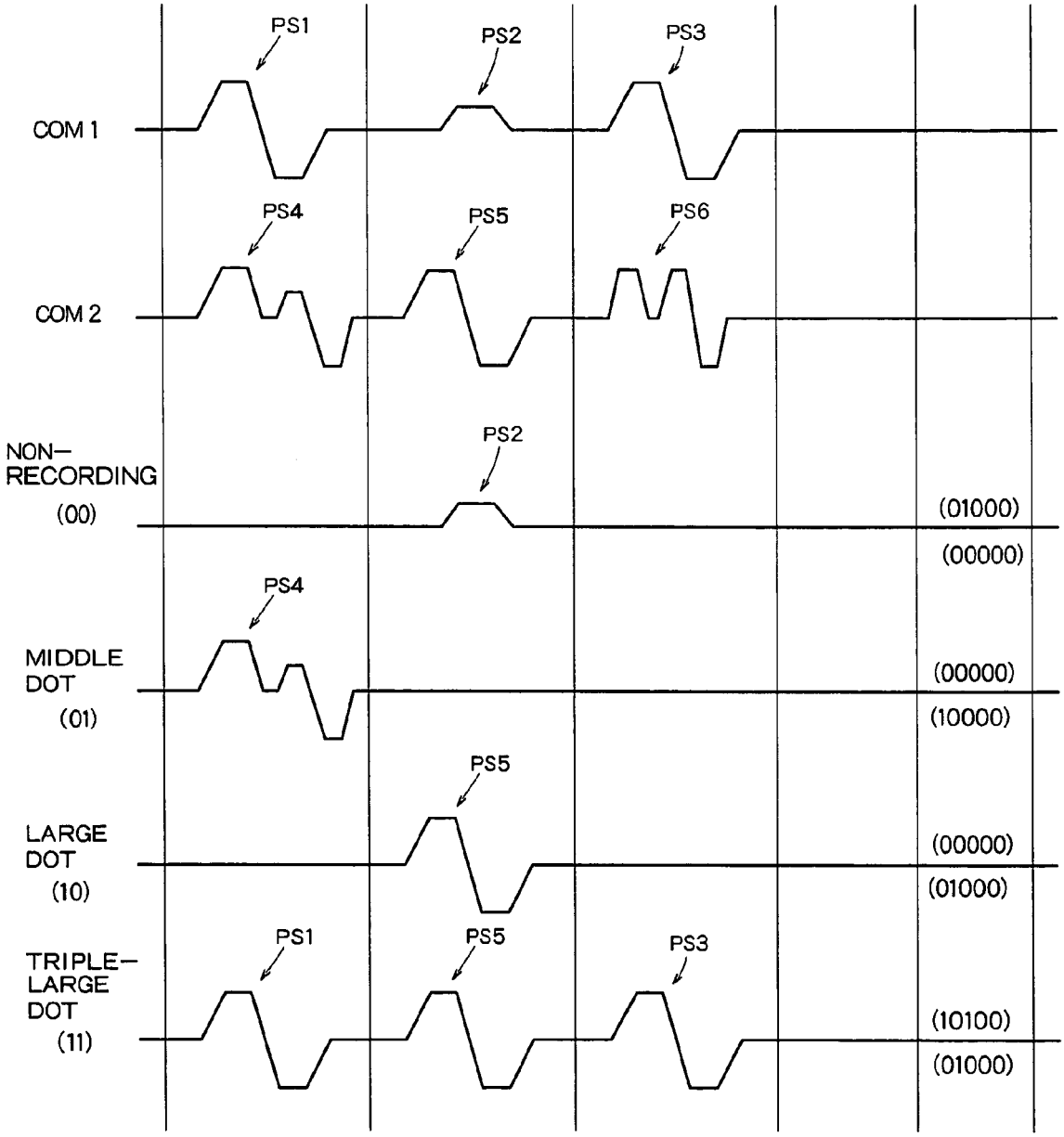
FIG. 6 is diagrams for explaining driving pulses for ejecting a deep-colored ink, generated based on the two driving signals shown in FIG. 5.
Figure 7:
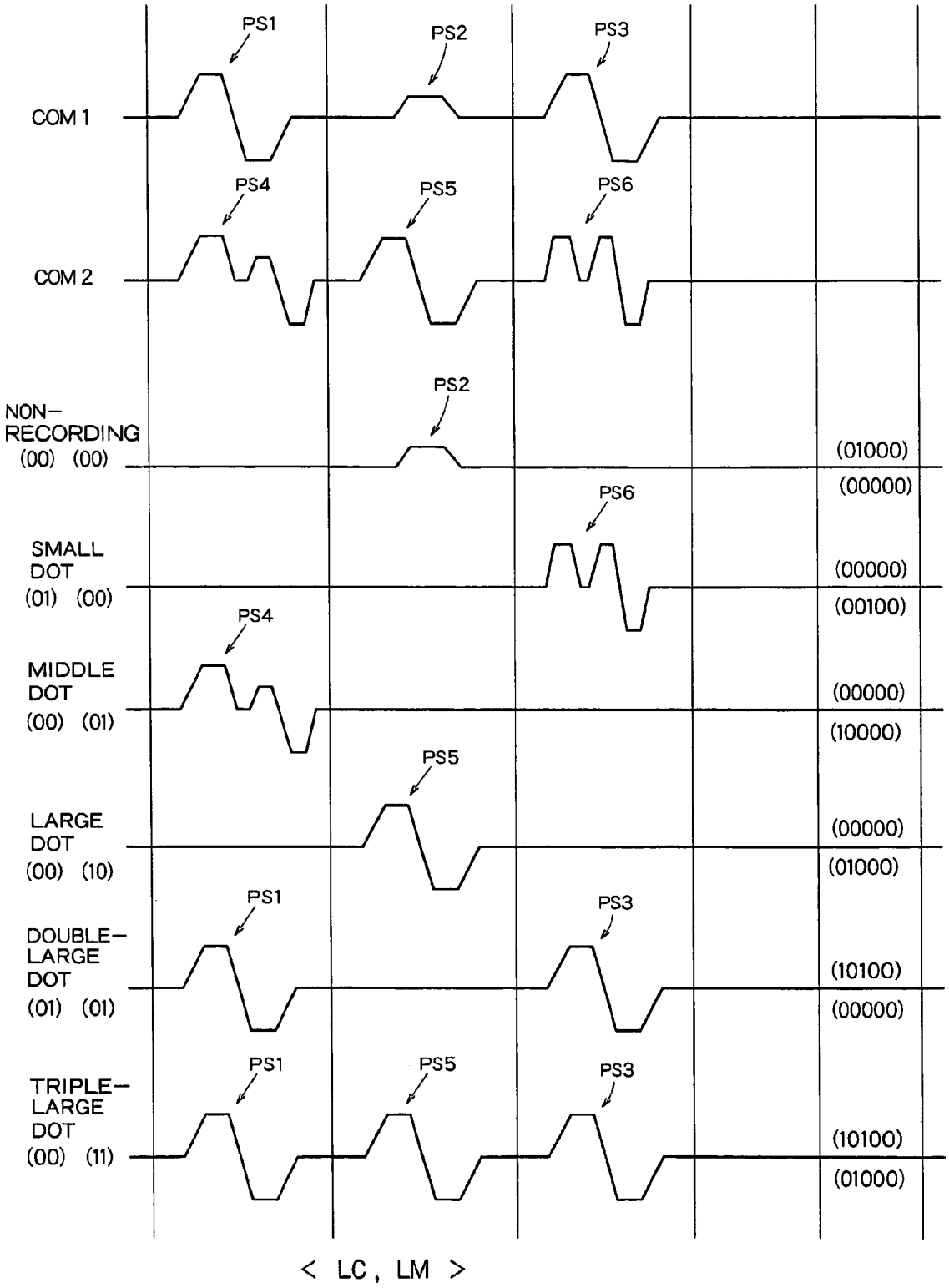
FIG. 7 is diagrams for explaining driving pulses for ejecting a light-colored ink, generated based on the two driving signals shown in FIG. 5.
Figure 8:
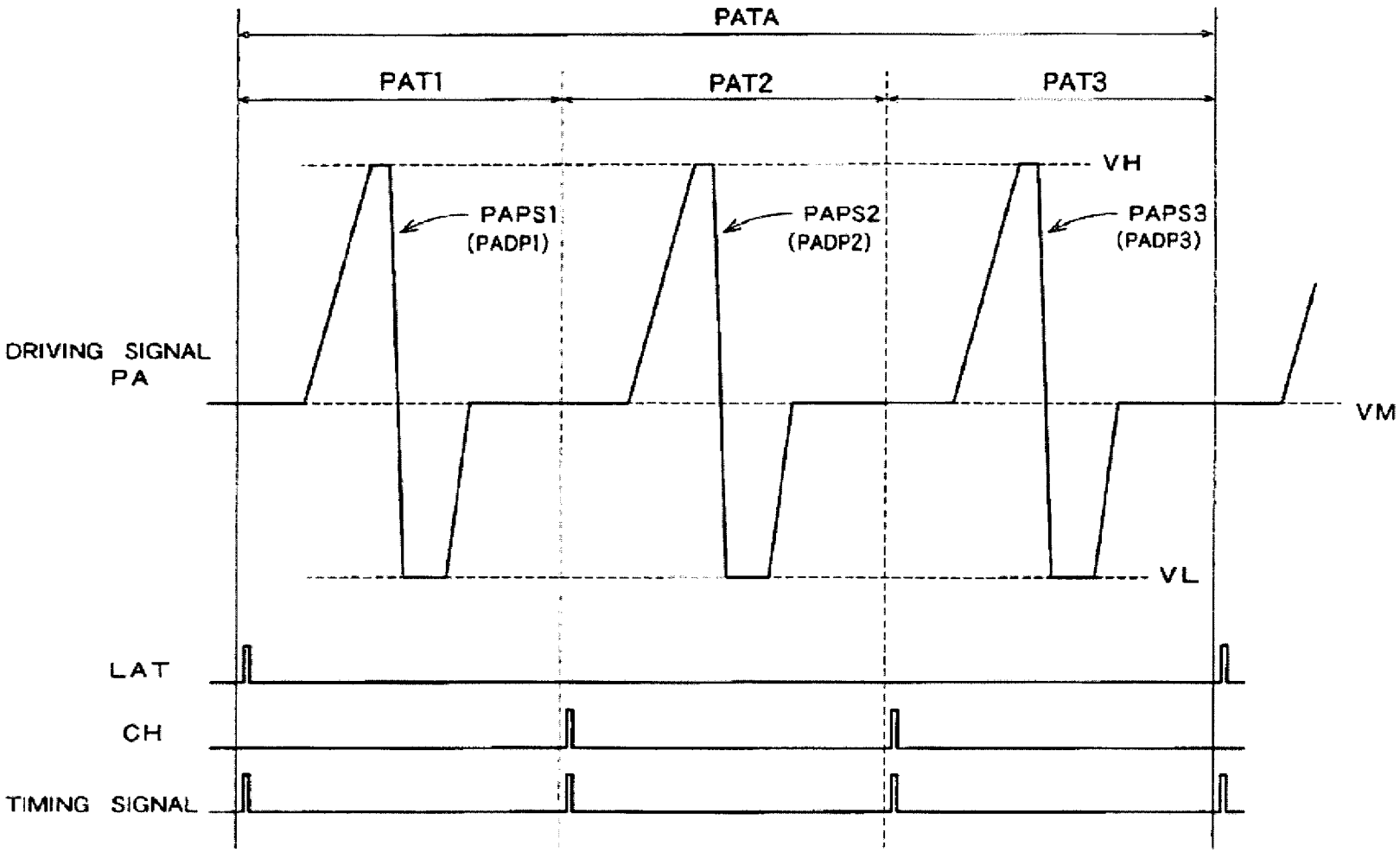
FIG. 8 Related Art
FIG. 8 is a diagram of an example of a conventional driving signal.
Figure 9:
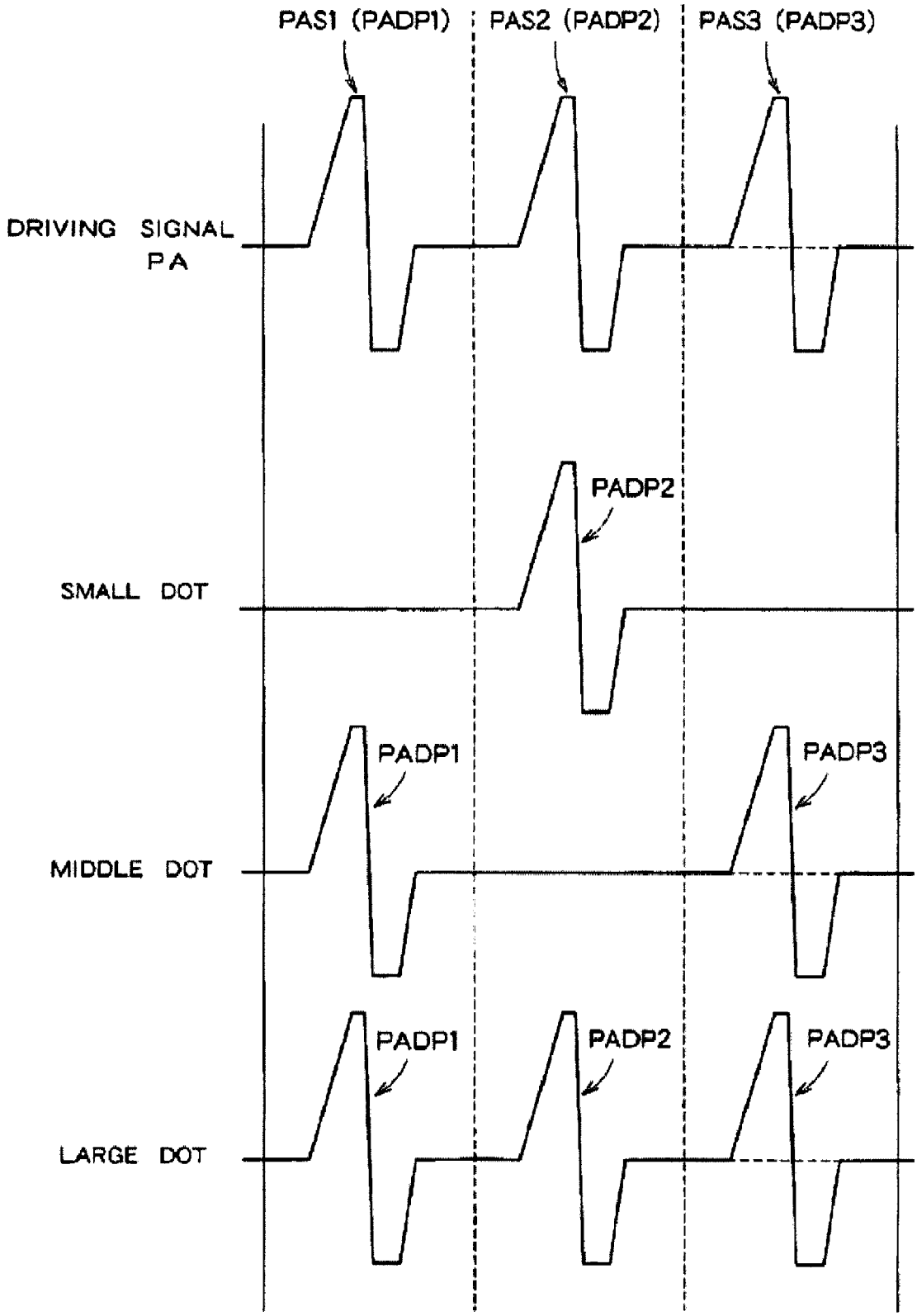
FIG. 9 is diagrams for explaining driving pulses generated based on the driving signal shown in FIG. 8.
Figure 10:
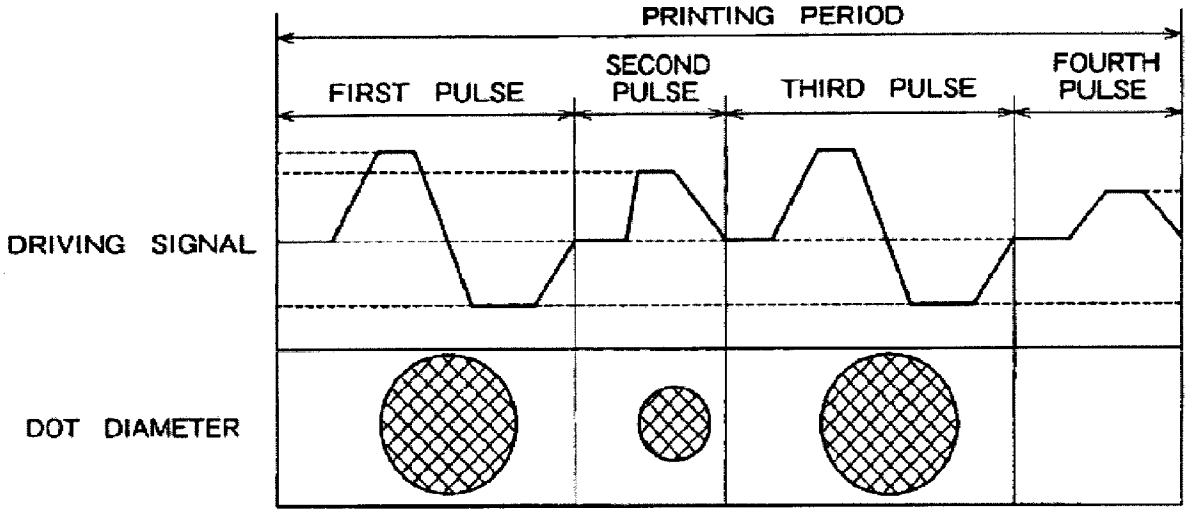
FIG. 10 Related Art
FIG. 10 is a diagram of another example of a conventional driving signal.

Then, as shown in FIGS. 6 and 7, a level control can be conducted by suitably selecting one or more pulse-waves to supply to the piezoelectric vibrating member 15. That is, when only the second pulse-wave PS2 is supplied to the piezoelectric vibrating member 15 as a driving pulse, a micro vibration is caused without recording any dot (FIGS. 6 and 7); when only the sixth pulse-wave PS6 is supplied to the piezoelectric vibrating member 15 as a driving pulse, a small dot is recorded (FIG. 7); when only the fourth pulse-wave PS4 is supplied to the piezoelectric vibrating member 15 as a driving pulse, a middle dot is recorded (FIGS. 6 and 7); when only the fifth pulse-wave PS5 is supplied to the piezoelectric vibrating member 15 as a driving pulse, a large dot is recorded (FIGS. 6 and 7); when only the first pulse-wave PS1 and the third pulse-wave PS3 are supplied to the piezoelectric vibrating member 15 as a driving pulse, a double-large dot is recorded (FIG. 7); and when only the first pulse-wave PS1, the fifth pulse-wave PS5 and the third pulse-wave PS3 are supplied to the piezoelectric vibrating member 15 as a driving pulse, a triple-large dot is recorded (FIGS. 6 and 7). In the case, the three pulse-waves PS1, PS5 and PS3 appear in that order at regular intervals.

Herein, regarding the deep-colored inks, a pulse-selecting data generated based on the no ejecting (no recording) data (level data (00)), a pulse-selecting data generated based on the middle dot data (level data (01)), a pulse-selecting data generated based on the large dot data (level data (10)), and a pulse-selecting data generated based on the triple-large data (level data (11)) are specifically explained with reference to FIG. 6.

In the case, the decoder 42 generates a first pulse-selecting data and a second pulse-selecting data, each of which consists of five bits, based on each dot-pattern data (level data) consisting of a single 2-bit data. Specifically, when the dot-pattern data is "(00)", a first pulse-selecting data (01000) and a second pulse-selecting data (00000) are generated; when the dot-pattern data is "(01)", a first pulse-selecting data (00000) and a second pulse-selecting data (10000) are generated; when the dot-pattern data is "(10)", a first pulse-selecting data (00000) and a second pulse-selecting data (01000) are generated; and when the dot-pattern data is "(11)", a first pulse-selecting data (10100) and a second pulse-selecting data (01000) are generated.

An uppermost bit of the first pulse-selecting data corresponds to the first pulse-wave PS1. A second uppermost bit of the first pulse-selecting data corresponds to the second pulse-wave PS2. A third uppermost bit of the first pulse-selecting data corresponds to the third pulse-wave PS3.

An uppermost bit of the second pulse-selecting data corresponds to the fourth pulse-wave PS4. A second uppermost bit of the second pulse-selecting data corresponds to the fifth pulse-wave PS5. A third uppermost bit of the second pulse-selecting data corresponds to the sixth pulse-wave PS6.

When the uppermost bit of the first pulse-selecting data is "1", the first switching circuit 46 (driving-pulse generator) is closed (connected) from a first timing signal (LAT signal), which corresponds to start of the term T11, to a second timing signal (CH signal), which corresponds to start of the term T12. In addition, when the second uppermost bit of the first pulse-selecting data is "1", the first switching circuit 46 is closed from the second timing signal to a third timing signal (CH signal), which corresponds to start of the term T13. Similarly, when the third uppermost bit of the first pulse-selecting data is "1", the first switching circuit 46 is closed from the third timing signal to a fourth timing signal (CH signal), which corresponds to start of the term T14. Similarly, when the fourth uppermost bit of the first pulse-selecting data is "1", the first switching circuit 46 is closed from the fourth timing signal to a fifth timing signal (CH signal), which corresponds to start of the term T15. Similarly, when the lowermost bit of the first pulse-selecting data is "1", the first switching circuit 46 is closed from the fifth timing signal to a timing signal (LAT signal) which corresponds to start of the term T11 of the next printing period T1.

On the other hand, when the uppermost bit of the second pulse-selecting data is "1", the second switching circuit 47 (driving-pulse generator) is closed (connected) from the first timing signal (LAT signal), which corresponds to the start of the term T11, to the second timing signal (CH signal), which corresponds to the start of the term T12. In addition, when the second uppermost bit of the second pulse-selecting data is "1", the second switching circuit 47 is closed from the second timing signal to the third timing signal (CH signal), which corresponds to the start of the term T13. Similarly, when the third uppermost bit of the second pulse-selecting data is "1", the second switching circuit 47 is closed from the third timing signal to the fourth timing signal (CH signal), which corresponds to the start of the term T14. Similarly, when the fourth uppermost bit of the second pulse-selecting data is "1", the second switching circuit 47 is closed from the fourth timing signal to the fifth timing signal (CH signal), which corresponds to the start of the term T15. Similarly, when the lowermost bit of the second pulse-selecting data is "1", the second switching circuit 47 is closed from the fifth timing signal to the timing signal (LAT signal) which corresponds to the start of the term T11 of the next printing period T1.

Thus, based on the non-recording dot-pattern data, only the second pulse-wave PS2 is supplied to the corresponding piezoelectric vibrating member 15. In addition, based on the middle-dot dot-pattern data, only the fourth pulse-wave PS4 is supplied to the corresponding piezoelectric vibrating member 15. Similarly, based on the large-dot dot-pattern data, only the fifth pulse-wave PS5 is supplied to the corresponding piezoelectric vibrating member 15. Similarly, based on the triple-large-dot dot-pattern data, only the first pulse-wave PS1, the fifth pulse-wave PS5 and the third pulse-wave PS3 are supplied to the corresponding piezoelectric vibrating member 15 (see FIG. 6).

As a result, correspondingly to the non-recording dot-pattern data, the ink in the nozzle 13 is caused to minutely vibrate. In addition, correspondingly to the middle-dot dot-pattern data, one middle-dot drop of the ink is ejected from the nozzle 13. The volume of the ejected drop of the ink is about 3 pl. Thus, a middle dot is formed on the recording paper 8. Correspondingly to the large-dot dot-pattern data, one large-dot drop of the ink is ejected from the nozzle 13. The volume of the ejected drop of the ink is about 7 pl. Thus, a large dot is formed on the recording paper 8. Correspondingly to the triple-large-dot dot-pattern data, three large-dot drops of the ink are ejected from the nozzle 13. The volume of the ejected drops of the ink is about 21 (7×3) pl in total. Thus, a triple-large dot is formed on the recording paper 8.

On the other hand, regarding the light-colored inks, a pulse-selecting data generated based on the no ejecting (no recording) data (level data (00)(00)), a pulse-selecting data generated based on the small dot data (level data (01)(00)), a pulse-selecting data generated based on the middle dot data (level data (00)(01)), a pulse-selecting data generated based on the large dot data (level data (00)(10)), a pulse-selecting data generated based on the double-large data (level data (01)(01)), and a pulse-selecting data generated based on the triple-large data (level data (00)(11)) are specifically explained with reference to FIG. 7.

In the case, the decoder 42 generates a first pulse-selecting data and a second pulse-selecting data, each of which consists of five bits, based on each dot-pattern data (level data) consisting of sequential two 2-bit data. Specifically, when the dot-pattern data is "(00)(00)", a first pulse-selecting data (01000) and a second pulse-selecting data (00000) are generated; when the dot-pattern data is "(01)(00)", a first pulse-selecting data (00000) and a second pulse-selecting data (00100) are generated; when the dot-pattern data is "(00)(01)", a first pulse-selecting data (00000) and a second pulse-selecting data (10000) are generated; when the dot-pattern data is "(00)(10)", a first pulse-selecting data (00000) and a second pulse-selecting data (01000) are generated; when the dot-pattern data is "(01)(01)", a first pulse-selecting data (10100) and a second pulse-selecting data (00000) are generated; and when the dot-pattern data is "(00)(11)", a first pulse-selecting data (10100) and a second pulse-selecting data (01000) are generated.

An uppermost bit of the first pulse-selecting data corresponds to the first pulse-wave PS1. A second uppermost bit of the first pulse-selecting data corresponds to the second pulse-wave PS2. A third uppermost bit of the first pulse-selecting data corresponds to the third pulse-wave PS3.

An uppermost bit of the second pulse-selecting data corresponds to the fourth pulse-wave PS4. A second uppermost bit of the second pulse-selecting data corresponds to the fifth pulse-wave PS5. A third uppermost bit of the second pulse-selecting data corresponds to the sixth pulse-wave PS6.

When the uppermost bit of the first pulse-selecting data is "1", the first switching circuit 46 (driving-pulse generator) is closed (connected) from a first timing signal (LAT signal), which corresponds to start of the term T11, to a second timing signal (CH signal), which corresponds to start of the term T12. In addition, when the second uppermost bit of the first pulse-selecting data is "1", the first switching circuit 46 is closed from the second timing signal to a third timing signal (CH signal), which corresponds to start of the term T13. Similarly, when the third uppermost bit of the first pulse-selecting data is "1", the first switching circuit 46 is closed from the third timing signal to a fourth timing signal (CH signal), which corresponds to start of the term T14. Similarly, when the fourth uppermost bit of the first pulse-selecting data is "1", the first switching circuit 46 is closed from the fourth timing signal to a fifth timing signal (CH signal), which corresponds to start of the term T15. Similarly, when the lowermost bit of the first pulse-selecting data is "1", the first switching circuit 46 is closed from the fifth timing signal to a timing signal (LAT signal) which corresponds to start of the term T11 of the next printing period T1.

On the other hand, when the uppermost bit of the second pulse-selecting data is "1", the second switching circuit 47 (driving-pulse generator) is closed (connected) from the first timing signal (LAT signal), which corresponds to the start of the term T11, to the second timing signal (CH signal), which corresponds to the start of the term T12. In addition, when the second uppermost bit of the second pulse-selecting data is "1", the second switching circuit 47 is closed from the second timing signal to the third timing signal (CH signal), which corresponds to the start of the term T13. Similarly, when the third uppermost bit of the second pulse-selecting data is "1", the second switching circuit 47 is closed from the third timing signal to the fourth timing signal (CH signal), which corresponds to the start of the term T14. Similarly, when the fourth uppermost bit of the second pulse-selecting data is "1", the second switching circuit 47 is closed from the fourth timing signal to the fifth timing signal (CH signal), which corresponds to the start of the term T15. Similarly, when the lowermost bit of the second pulse-selecting data is "1", the second switching circuit 47 is closed from the fifth timing signal to the timing signal (LAT signal) which corresponds to the start of the term T11 of the next printing period T1.

Thus, based on the non-recording dot-pattern data, only the second pulse-wave PS2 is supplied to the corresponding piezoelectric vibrating member 15. In addition, based on the small-dot dot-pattern data, only the sixth pulse-wave PS6 is supplied to the corresponding piezoelectric vibrating member 15. Similarly, based on the middle-dot dot-pattern data, only the fourth pulse-wave PS4 is supplied to the corresponding piezoelectric vibrating member 15. Similarly, based on the large-dot dot-pattern data, only the fifth pulse-wave PS5 is supplied to the corresponding piezoelectric vibrating member 15. Similarly, based on the double-large-dot dot-pattern data, only the first pulse-wave PS1 and the third pulse-wave PS3 are supplied to the corresponding piezoelectric vibrating member 15. Similarly, based on the triple-large-dot dot-pattern data, only the first pulse-wave PS1, the fifth pulse-wave PS5 and the third pulse-wave PS3 are supplied to the corresponding piezoelectric vibrating member 15 (see FIG. 7).

As a result, correspondingly to the non-recording dot-pattern data, the ink in the nozzle 13 is caused to minutely vibrate. In addition, correspondingly to the small-dot dot-pattern data, one small-dot drop of the ink is ejected from the nozzle 13. The volume of the ejected drop of the ink is about 1.5 pL. Thus, a small dot is formed on the recording paper 8. Correspondingly to the middle-dot dot-pattern data, one middle-dot drop of the ink is ejected from the nozzle 13. The volume of the ejected drop of the ink is about 3 pl. Thus, a middle dot is formed on the recording paper 8. Correspondingly to the large-dot dot-pattern data, one large-dot drop of the ink is ejected from the nozzle 13. The volume of the ejected drop of the ink is about 7 pl. Thus, a large dot is formed on the recording paper 8. Correspondingly to the double-large-dot dot-pattern data, two large-dot drops of the ink are ejected from the nozzle 13. The volume of the ejected drops of the ink is about 14 (7×2) pl in total. Thus, a double-large dot is formed on the recording paper 8. Correspondingly to the triple-large-dot dot-pattern data, three large-dot drops of the ink are ejected from the nozzle 13. The volume of the ejected drops of the ink is about 21 (7×3) pl in total. Thus, a triple-large dot is formed on the recording paper 8.

As described above, according to the present embodiment, the level control based on the ejecting data for the deep-colored inks and the level control based on the ejecting data for the light-colored inks are carried out independently (separately) and differently. Thus, the level control with five or more patterns can be achieved for only the light-colored inks. That is, for the deep-colored inks, an unnecessary level control is not carried out, which can save various costs.

In addition, according to the present embodiment, since the level data for the light-colored inks consists of the sequential two 2-bit data, any conventional controlling circuit for 2-bit level data may be used while the level control of six patterns (non-recording, small, middle, large, double-large and triple-large) can be achieved for the light-colored inks.

In addition, according to the present embodiment, since the degree of signal change (voltage change) between the two driving signals COM1 and COM2 is uniformized (equalized), load of circuit components such as the driving-signal generator can be reduced. Thus, lifetime of the circuit components or the like can be remarkably improved.

In addition, according to the present embodiment, the first pulse-wave PS1, the fifth pulse-wave PS5 and the third pulse-wave PS3 have the same waveform and appear at the regular intervals, so that the first pulse-wave PS1, the fifth pulse-wave PS5 and the third pulse-wave PS3 look like conventional "multi-shot" pulse-waves. Thus, the present embodiment is suitable for a high-frequency driving.

In addition, according to the present embodiment, three waveforms respectively for a small dot, a middle dot and a large dot are divided into the two driving signals COM1 and COM2. Thus, a level control can be achieved with higher granularity (graininess).

Herein, each of the first driving-signal generating circuit 30*a* and the second driving-signal generating circuit 30*b* may be formed by a DAC circuit or an analogue circuit.

A pressure-changing unit for changing the volume of the pressure chamber 16 is not limited to the piezoelectric vibrating member 15. For example, a pressure-changing unit can consist of a magnetic distortion (magnetostrictive) device. In the case, the magnetic distortion device causes the pressure chamber 16 to expand and contract, thus, changes the pressure of the ink in the pressure chamber 16. Alternatively, a pressure-changing unit can consist of a heating device. In the case, the heating device causes an air bubble in the pressure chamber 16 to expand and contract, thus, changes the pressure of the ink in the pressure chamber 16.

In addition, as described above, the printer controller 23 can be materialized by a computer system. A program for materializing the above one or more components in a computer system, and a storage unit 201 storing the program and capable of being read by a computer, are intended to be protected by this application.

In addition, when the above one or more components may be materialized in a computer system by using a general program such as an OS, a program including a command or commands for controlling the general program, and a storage unit 202 storing the program and capable of being read by a computer, are intended to be protected by this application.

Each of the storage units 201 and 202 can be not only a substantial object such as a floppy disk (flexible disk) or the like, but also a network for transmitting various signals.

The above description is given for the ink-jetting printer as a liquid ejecting apparatus according to the invention. However, this invention is intended to apply to general liquid ejecting apparatuses widely. A liquid may be glue, nail polish, conductive liquid (liquid metal), organic liquid or the like, instead of the ink. Furthermore, this invention can be applied to a manufacturing unit for color filters of a display apparatus such as LCD.

What is claimed is:

1. A liquid ejecting apparatus comprising;

a head having a nozzle;

a pressure-changing unit for changing pressure of liquid in the nozzle in such a manner that the liquid is ejected from the nozzle;

a first level-data setting unit for setting a selected first level data from a plurality of first level data, based on an ejecting data for a first kind of liquid;

a second level-data setting unit for setting a selected second level data from a plurality of second level data, based on an ejecting data for a second kind of liquid;

a driving-signal generator for generating a driving signal; and a driving-pulse generator for generating a driving pulse based on the selected first or second level data and the driving signal, wherein the plurality of first level data and the plurality of second level data are different from each other, the driving-signal generator is adapted to generate a first driving signal and a second driving signal, the driving-pulse generator is adapted to generate a driving pulse based on the selected first or second level data and the first driving signal and the second driving signal, the first driving signal and the second driving signal are periodical signals having a same period, the first driving signal includes in one period thereof a first large-drop pulse-wave, which is for ejecting a predetermined large drop of the liquid, and a third large-drop pulse-wave, which is for ejecting a predetermined large drop of the liquid, the second driving signal includes in one period thereof a second large-drop pulse-wave, which is for ejecting a predetermined large drop of the liquid, the first large-drop pulse-wave, the second large-drop pulse-wave and the third large-drop pulse-wave have a same waveform, and the first large-drop pulse-wave, the second large-drop pulse-wave and the third large-drop pulse-wave appear in that order at regular intervals.

2. A liquid ejecting apparatus according to claim 1, wherein:

the second driving signal further includes in one period thereof a small-drop pulse-wave, which is for ejecting a predetermined small drop of the liquid.

3. A liquid ejecting apparatus according to claim 2, wherein:

the second driving signal further includes in one period thereof a middle-drop pulse-wave, which is for ejecting a predetermined middle drop of the liquid.

4. A liquid ejecting apparatus according to claim 3, wherein:

the first driving signal further includes in one period thereof a micro-vibration pulse-wave, which is for causing a meniscus of the liquid to vibrate minutely without ejecting any drop of the liquid.

5. A liquid ejecting apparatus comprising:

a head having a nozzle;

a pressure-changing unit for changing pressure of liquid in the nozzle in such a manner that the liquid is ejected from the nozzle;

a first level-data setting unit for setting a selected first level data from a plurality of first level data, based on an ejecting data for a first kind of liquid;

a second level-data setting unit for setting a selected second level data from a plurality of second level data, based on an ejecting data for a second kind of liquid;

a driving-signal generator for generating a driving signal; and a driving-pulse generator for generating a driving pulse based on the selected first or second level data and the driving signal, wherein the plurality of first level data and the plurality of second level data are different from each other, the driving-signal generator is adapted to generate a first driving signal and a second driving signal, the driving-pulse generator is adapted to generate a driving pulse based on the selected first or second level data and the first driving signal and the second driving signal, the first driving signal and the second driving signal are periodical signals having a same period, the first driving signal includes in one period thereof a first large-drop pulse-wave, which is for ejecting a predetermined large drop of the liquid, the second driving signal includes in one period thereof a middle-drop pulse-wave, which is for ejecting a predetermined middle drop of the liquid, and a small-drop pulse-wave, which is for ejecting a predetermined small drop of the liquid, the first driving signal further includes in one period thereof a third large-drop pulse-wave, which is for ejecting a predetermined large drop of the liquid, the second driving signal further includes in one period thereof a second large-drop pulse-wave, which is for ejecting a predetermined large drop of the liquid, the first large-drop pulse-wave, the second large-drop pulse-wave and the third large-drop pulse-wave have a same waveform, and the first large-drop pulse-wave, the second large-drop pulse-wave and the third large-drop pulse-wave appear in that order at regular intervals.

6. A liquid ejecting apparatus according to claim 5, wherein:

the first level-data setting unit is adapted to set a selected first level data from four first level data, based on the ejecting data for a first kind of liquid, and the second level-data setting unit is adapted to set a selected second level data from six second level data, based on the ejecting data for a second kind of liquid.

7. A liquid ejecting apparatus according to claim 5, wherein:

the plurality of first level data include a non-ejecting data, a middle-dot data, a large-dot data and a triple-large-dot data, the driving-pulse generator is adapted to generate, based on the first driving signal and the second driving signal:

a driving-pulse including only the micro-vibration pulse-wave when the selected first level data is the non-ejecting data, a driving-pulse including only the middle-drop pulse-wave of the second driving signal when the selected first level data is the middle-dot data, a driving-pulse including only the second large-drop pulse-wave of the second driving signal when the selected first level data is the large-dot data, and a driving-pulse including the first large-drop pulse-wave of the first driving signal, the second large-drop pulse-wave of the second driving signal and the third large-drop pulse-wave of the first driving signal when the selected first level data is the triple-large-dot data, the plurality of second level data include a non-ejecting data, a small-dot data, a middle-dot data, a large-dot data, a double-large-dot data and a triple-large-dot data, and the driving-pulse generator is adapted to generate, based on the first driving signal and the second driving signal:

a driving-pulse including only the micro-vibration pulse-wave when the selected second level data is the non-ejecting data, a driving-pulse including only the small-drop pulse-wave of the second driving signal when the selected second level data is the small-dot data, a driving-pulse including only the middle-drop pulse-wave of the second driving signal when the selected second level data is the middle-dot data, a driving-pulse including only the second large-drop pulse-wave of the second driving signal when the selected second level data is the large-dot data, a driving-pulse including the first large-drop pulse-wave of the first driving signal and the third large-drop pulse-wave of the first driving signal when the selected second level data is the double-large-dot data, and a driving-pulse including the first large-drop pulse-wave of the first driving signal, the second large-drop pulse-wave of the second driving signal and the third large-drop pulse-wave of the first driving signal when the selected second level data is the triple-large-dot data.

* * * * *